United States Patent [19]
Boonman
[11] 4,318,256
[45] Mar. 9, 1982

[54] ANCHOR CONSTRUCTION FOR PRESTRESSING MEMBERS

[76] Inventor: Cornelis Johannes F. Boonman, Burgemeester Merkusstraat 6, Delfgauw, Netherlands

[21] Appl. No.: 37,304

[22] Filed: May 8, 1979

[30] Foreign Application Priority Data

May 16, 1978 [NL] Netherlands ..... 7805229

[51] Int. Cl.[3] ..... E04C 3/10
[52] U.S. Cl. ..... 52/223 R; 52/228
[58] Field of Search ..... 52/223 R, 223 L, 228, 52/230, 224, 227

[56] References Cited

U.S. PATENT DOCUMENTS

| | | | |
|---|---|---|---|
| 3,089,215 | 5/1963 | Stubbs | 52/223 R |
| 3,226,894 | 1/1966 | Burchardt | 52/223 L |
| 3,427,772 | 2/1969 | Williams | 52/223 R |
| 3,701,509 | 10/1972 | Stinton | 52/223 L |
| 3,872,635 | 3/1975 | Miram | 52/227 |
| 3,937,607 | 2/1976 | Rodermer | 52/223 L |
| 4,144,686 | 3/1979 | Gold | 52/223 R |

FOREIGN PATENT DOCUMENTS

| | | | |
|---|---|---|---|
| 155756 | 10/1952 | Australia | 52/223 R |
| 1143319 | 2/1963 | Fed. Rep. of Germany | 52/223 |
| 1278718 | 9/1968 | Fed. Rep. of Germany | 52/223 L |
| 1526738 | 4/1968 | France . | |
| 60490 | 8/1947 | Netherlands | 52/228 |

*Primary Examiner*—Price C. Faw, Jr.
*Assistant Examiner*—Henry E. Raduazo
*Attorney, Agent, or Firm*—Pennie & Edmonds

[57] ABSTRACT

An anchor-clamp is disclosed for clamping to a prestressing member (50) intermediate its length and over a support (68). The clamp (FIG. 1), after initial assembly, is packed in polystyrene blocks (62, 64) for shipment. At the site of use, the anchor-clamp, still in its foam package, is assembled to the prestressing member (50) and then the concrete is poured and allowed to set. After hardening of the concrete, the prestressed member (50) is stressed in the conventional way, the polystyrene package is removed from about the anchor-clamp and the clamp is operated to clamp the stressed prestressing member (50). Thereafter, the entire clamp is imbedded in concrete. When only one intermediate anchor-clamp is used, it may be clamped to the prestressing member (50) prior to the stressing of the same. The polystyrene foam package not only protects the clamp during shipment and assembly to the prestressing member but also protects the same from concrete or water when the concrete is poured and before removal of the polystyrene package. The clamp comprises a compression member (56) threaded to two tubular portions (52) of two substantially identical clamps (20, 30) arranged in facing relationship. The threading of the member (56) to the tubular portions (52) is left-handed for one of the members (52) and right-handed for the other member (52) so that upon rotation of the member (56), it will move the tubular portions (52) outwardly away from each other whereby wedge activators (44) bearing against wedges (32) drive the wedges (32) outwardly within frustoconical bore (28) in hubs (26). This outward movement of the wedges (32) causes them to move together and clamp to the outer surface of the prestressing member (50).

3 Claims, 5 Drawing Figures

ANCHOR CONSTRUCTION FOR PRESTRESSING MEMBERS

DESCRIPTION

Background of the Invention

The invention relates to an anchor construction for anchoring the prestressing member in a prestressed concrete structure. More particularly, the anchor is for use in the type of prestressed concrete construction in which the "prestress without attachment" system is used. In such construction, it is conventional to anchor the prestressing members only at their ends, even though there may be a number of supports intermediate the ends of the structure.

In this type of construction, in the event of a local collapse of the structure, it frequently occurs that the local collapse is propagated throughout the entire structure. For example, in the event a single prestressing member fails or the concrete in a particular area fails, the adjacent prestressing members must compensate for the lost strength. If they cannot compensate, they will collapse as well and the result will be a sort of chain reaction in which all of the prestressing members and the entire structure is destroyed.

BRIEF SUMMARY OF THE INVENTION

It is one purpose of the invention to overcome the deficiencies of the previous constructions and to confine any damage resulting from the failure of a single prestressing member or of the concrete to a given locality involving the failure. That is to say, the local damage will be confined to the locality of the failure and not propagated throughout the entire structure.

To this end, the anchor construction of this invention is arranged at one or more intermediate points between the ends of the prestressing members. The locations of these intermediate points where the anchor is provided are themselves positioned generally over underlying supports.

The anchor construction is detailed hereinafter, but comprises means surrounding a prestressing member which means may be operated to clamp the prestressing member tightly within it. The anchor or clamp is assembled and then is encased in polystyrene foam held together by straps in order to protect the same during transport and installation of the anchor. At the site, each of the prestressing members is passed through the center of an anchor-clamp at each intermediate location where it is desired to provide additional support.

After the assembly as just described, the concrete is poured at all locations where the same is desired except in the space occupied by the polystyrene block encasing the anchored clamp. After the concrete has set, the prestressing members are prestressed in the conventional manner, after which the foam is removed from the anchor-clamps and the anchor-clamps operated to tightly clamp the prestressing member. Subsequently, the clamp itself is imbedded in concrete with concrete filling all of the space previously occupied by the polystyrene foam.

In an alternate manner of use where only a single intermediate anchor is to be provided (usually mid-way of the length of the prestressing member), the sequence may be slightly altered.

In this latter case, the prestressing member is passed through the anchor-clamp which is positioned intermediate the length of the prestressing member. The anchor-clamp is still imbedded in the block or blocks of polystyrene and the concrete is poured. After the concrete has set, the prestressing members could be stressed in the manner as abovedescribed; however, it is also possible with only the single intermediate anchor to first remove the polystyrene from around the anchor, operate the anchor to clamp to the prestressing member, and then prestress the member or members. Again, the final step is to imbed the anchor-clamp itself in the concrete, thus tieing the same to the underlying support. This second arrangement is particularly useful with long prestressing members with few intermediate supports where friction between the prestressing member and its enclosure reduces the prestressing otherwise possible. With more than one intermediate anchor, it is not possible to clamp before stressing as just described.

DETAILED DESCRIPTION OF THE PREFERRED EMBODIMENT

Figure 1:
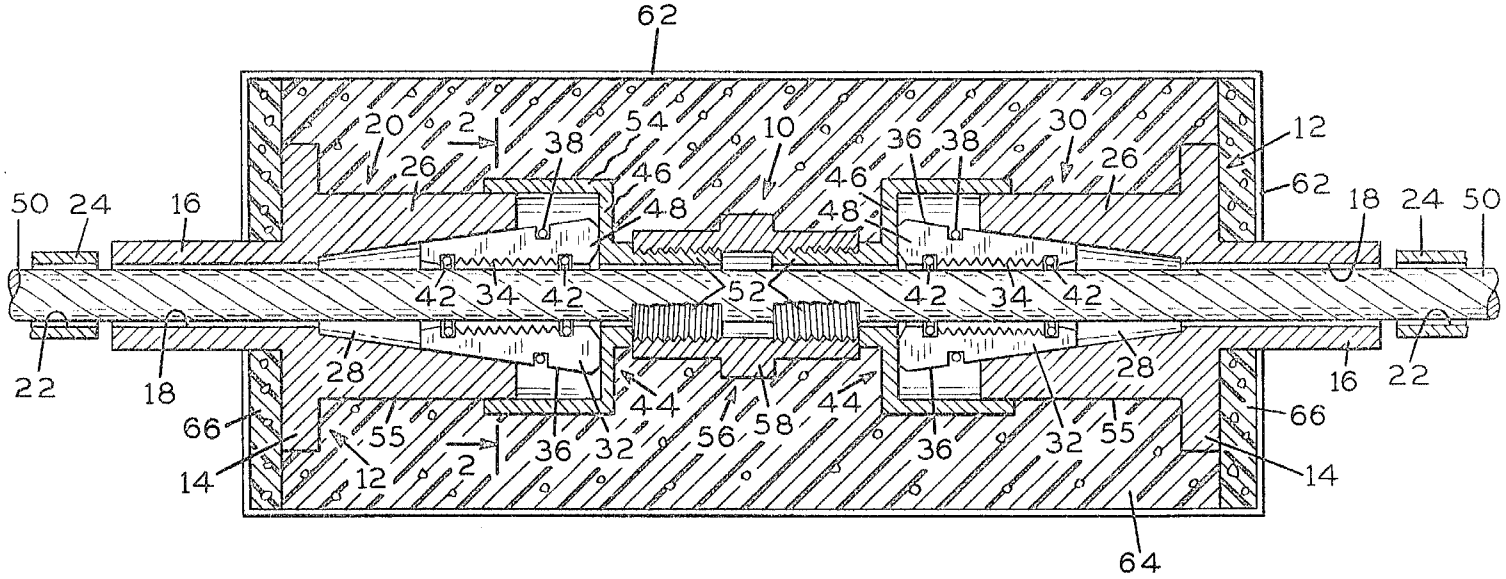
FIG. 1 is a longitudinal cross-section through the anchor-clamp of the invention taken along line 1—1 of FIG. 3.

The anchor construction of the invention as shown in FIG. 1 comprises two clamps, generally indicated at 20 and 30, both of which are designed to be clamped to the prestressing member 50 upon operation of the threaded compressing member, generally indicated at 10. Each of the clamps 20 and 30 is identical and they are assembled in facing relation, as shown in FIG. 1. Accordingly, the same reference numerals are used for the same elements of each clamp.

Each clamp 20 and 30 has a sleeve, generally indicated at 12, which includes a radial flange 14 intermediate the length of the sleeve 12. Extending outwardly from the flange 14, each of the sleeves includes a tubular section 16. The cylindrical opening 18, extending longitudinally through the flange 14 and tubular section 16, is of the same diameter as the cylindrical opening 22 extending through the casing 24.

The casing 24 extends substantially throughout the length of the prestressing member 50, except in those locations occupied by the anchor-clamp of the invention. Such casings 24, positioned about prestressing member 50, are conventionally known and are ultimately imbedded in the concrete.

Figure 2:
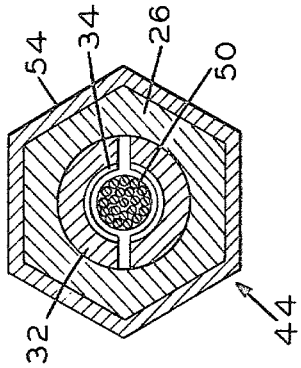
FIG. 2 is a transvere cross-section taken along the line 2—2 of FIG. 1.

Inwardly of the flanges 14, the sleeves 12 have wedge receiving hubs 26. Internally, the wedge-receiving hubs 26 have tapered, generally frusto-conical bore 28. Positioned within each of the bores 28 are a plurality of wedges 32. The number of wedges 32 positioned within each of the bores 28 may be 2, 3 or a higher number as desired. As shown in FIGS. 1 and 2, there are two wedges 32 for each of the bores 28. Each wedge 32 surrounds substantially half the circumference (i.e. 180°) of the prestressing member 50 (see FIG. 2). For clarity, the wedge member 32 closest to the viewer as seen in FIG. 1 is not shown.

While the internal surface 34 of each wedge 32 subscribes a semi-cylinder so that two cooperating wedges 32 define substantially a cylindrical opening therethrough, the exterior surfaces 36 of the wedges 32 are generally frusto-conical for cooperation with the frusto-conical bores 28. In a suitable groove in the surface 36 of the wedge members 32, there is positioned a clamping spring 38. Internally, the surfaces 34 have a saw-toothed surface for gripping the prestressing member 50 when the clamp is operated. In each of the surfaces 34, each of the wedges 32 have open annular springs 42 mounted in suitable grooves. During assembly and shipment of the anchor-clamp of the invention, the clamping spring 38 together with the hub 26 retain the wedges 32 in place. At the same time, however, the internal springs 42 urge the wedges 32 outwardly to the extent permitted by the bore 28 in the hub 26. This provides sufficient opening through the wedges to permit the easy passage of the stressing member 50 when the anchor is assembled to the stressing member 50 on site. Such is the condition shown in FIG. 1.

It will be appreciated that the total outward force exerted by the open annular springs 42 must be at least slightly greater than the inward force applied by the clamping springs 38, in order to insure that the opening 34 in the wedges remains open for assembly with the prestressing member 50. At the same time, however, the springs 42 do not totally overcome the inward clamping force of the springs 38 since the wedges must be maintained in assembled position. Also, the maintenance of assembly is maintained by the fact that the wedges 32 are within the frusto-conical bore 28 during shipment and subsequent assembly with the prestressing member 50.

Clamps 20 and 30 also include wedge activators 44. Wedge activators 44 include an annular pressure plate 46 which bears against the wider inner ends 48 of the wedges 32. Extending inwardly of the anchor-clamp of the invention from the pressure plates 46 are tubular members 52 having a cylindrical opening therethrough which also extends through the pressure plate 46 and is of a diameter equal to that of the cylindrical opening within the casing 24, and the opening 18 within the tubular sections 16 and the flange 14.

Each wedge activator 44 also includes an outwardly extending annular wall 54 which surrounds the hub 26. The exterior surface of the tubular members 52 are threaded. Threaded onto the tubular members 52 is a compression member 56. In the center portion of the compression member 56 is a portion 58 which may be square, hexagonal, or have such other shape as may be desired and which may accommodate a suitable wrench for rotating the same.

The threads on the tubular members 52 which are engaged with the compression member 56 are the only point at which the clamps 20 and 30 differ. The design is such that upon rotation of the compression member 56 in one direction, the wedge activators 44 are drawn toward each other to the limit shown in FIG. 1. Upon rotation of the compression member 5 in the opposite direction, its threaded engagement with the tubular members 52 will force the wedge activators 44 outwardly away from each other. To this end, one of the tubular members 52 and the cooperating threaded portion of the compression member 56 must have a left-hand thread while the other tubular member 52 and its cooperating threaded portion of the compression member 56 must have a right-hand thread. It will be appreciated that this is much like a conventional turnbuckle. Still further, in order to provide for this inward and outward operation of the wedge activators 44, the annular wall 54 of each of the activators 44 has a hexagonal shape which mates for non-rotation with respect to but for longitudinal sliding relationship with respect to the exterior surface 55 of the hub 26. The exterior surface 55 of the hub 26 is of the same hexagonal shape as the shape of the annular wall 54. As shown in FIG. 2, both the inner and outer surfaces of the annular wall 54 are hexagonal although it is only necessary that the inner surface have the hexagonal (square or other) shape in order to fit the outer surface of hub 26.

As shown in FIGS. 1 and 2, after assembly of the anchor-clamp parts, they are encased in polystyrene blocks which are held in place by straps 62. The manner in which this is accomplished will be apparent to those familiar with the packaging art and it may vary. It is only necessary that the polystyrene not only protect the anchor during transportation and handling and during assembly to the prestressing members 50, but also the polystyrene must prevent the concrete which is to be poured around its periphery from invading the working mechanism of the anchor either as concrete or as water bearing some cement. As shown in the drawings, there is a pair of central blocks of foam 64 meeting along the plane 63 and an end-slab 66 on each end, all of which are held in place by the metal straps 62. As shown, the tubular sections 16 extend outwardly of the polystyrene encasement.

MATERIALS

Various materials are contemplated for the several parts of the device. The sleeves 12 may be made of crucible steel or cast steel. The wedges 32 are preferably of a hardened steel. The open annular springs 42 are preferably of spring steel and the clamping springs 38 are preferably of spring steel, although they may be of rubber. The wedge activators 44 and the compression member 56 are preferably of crucible steel.

OPERATION AND METHOD OF USE

Figure 4:
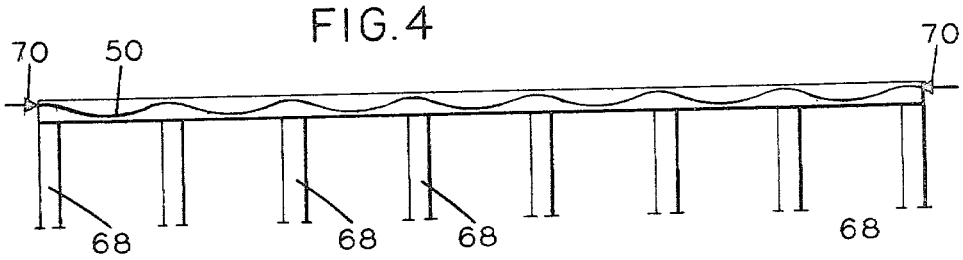
FIG. 4 is a schematic representation of a concrete structure of the conventional type extending over more than two support positions with prestressing members anchored only at the ends.

In FIG. 4 is shown a conventional construction of a prestressed concrete slab having a plurality (only one shown) of prestressing members 50. The single slab is supported by vertical upright supports 68 which may be reinforced concrete pillars, or steel pillars, or the like. In this construction, the entire horizontal member is framed and the concrete poured with the prestressing member 50 and its casing 24 (not shown in FIG. 4) imbedded therein. After the concrete has set, stressing of the prestressing member 50 is accomplished in the usual manner and the same is clamped at the ends 70. It will be appreciated that each of the several prestressing members 50 that may be present are so stressed. It will also be appreciated that in the event of failure of the concrete at any particular location or of one of the prestressing members 50, the stress provided by that member throughout the length of the slab is lost and must be compensated for by the remaining prestressing members 50 and the remaining concrete.

Figure 3:
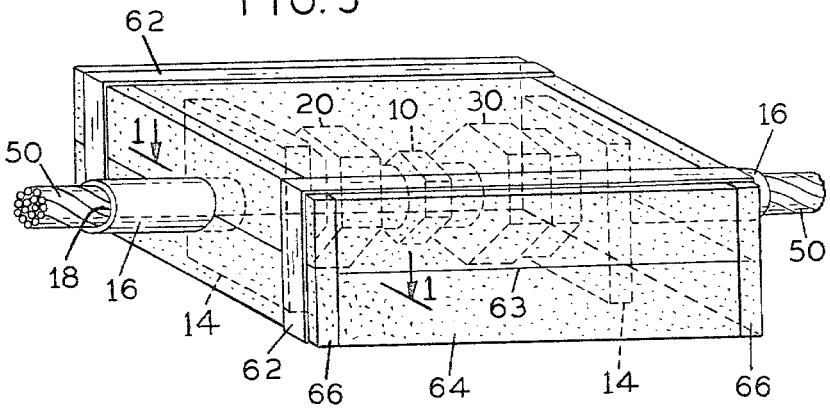
FIG. 3 is a perspective view of the anchor-clamp as packed in the polystyrene foam.
Figure 5:
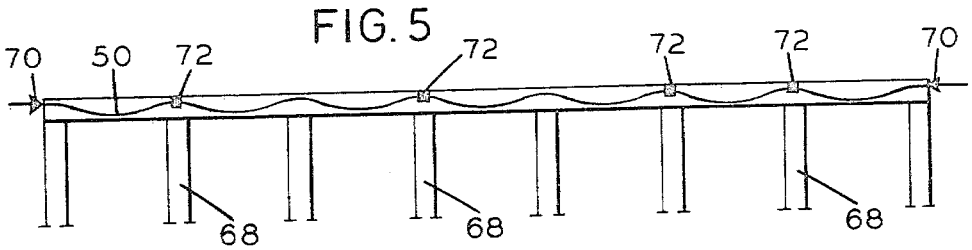
FIG. 5 shows schematically the concrete structure of FIG. 4, in which there are a number of intermediate anchors incorporated in the structure over selected ones of the intermediate support members.

In accordancae with this invention, however, intermediate anchors are provided as schematically shown in FIG. 5. As before, the slab is supported by upright supports 68 and is anchored at the end points 70. However, in this instance, at each of the locations indicated by the numeral 72, the anchor-clamp disclosed in FIGS. 1 through 3 is provided. It will be noted that each of the locations 72 is positioned above a support 68. In accordance with this system, the prestressing members 50 are threaded through the anchor-clamp of FIG. 1 at each of the locations 72 while still encased in the polystyrene blocks 62, 64. After that, the slab is poured and the concrete allowed to set. Then all of the prestressing members 50 are prestressed in the conventional way and anchored at their ends indicated by the numerals 70. In addition, at each of the locations 72 where there is an anchor-clamp of the type shown in FIGS. 1 through 3, the protective polystyrene blocks 62, 64 are removed. Then, the compression member 10 is rotated to force the wedge activators 44 apart. This outward movement of the wedge activators 44 is imparted to the wedge elements 32. Because of the cooperating frusto-conical shape of the surfaces 28 and 36, the wedge elements 32 within each hub 26 are forced toward each other and toward the prestressing member 50. With sufficient operation of the compression member 10, the wedges 32 will tightly grip the prestressing member 50 with their internal sawteeth on the surfaces 34. Thus, the anchor-clamp of FIG. 1 becomes tightly secured to the stressed prestressing member 50. After activating the anchor-clamp so that the wedges 32 tightly grip the prestressing member 50, the space previously occupied by the polystyrene foam is then filled with concrete and allowed to set. In this manner, the anchor-clamp is integrated with the structure and with the underlying support 68 as well as remaining tightly clamped to the prestressing member 50.

It will be appreciated that in accordance with this system, should a failure occur either of concrete or of a particular prestressing member, it will be limited in its effect to the distance between two adjacent anchor-clamps or between the last anchor-clamps and the end anchors located at 70. In such an arrangement, propagation of the initial failure is avoided and the damage confined to a local area.

MODIFIED METHOD OF USE

As mentioned above, it is possible to clamp the anchor-clamp to the prestresssing member before applying the stress to the prestressing member. However, this can only be accomplished when there is but one intermediate anchor-clamp since if there were two or more intermediate clamps, stressing of the prestressing member 50 from the ends would be ineffective beyond the next closest anchor-clamp that was clamping the stressing member 50.

While the device of FIGS. 1 through 3 is intended primarily for use at intermediate points along the lengths of a prestressing member, it will be appreciated that the same can be used, if desired, with or without suitable modification at the ends 70 of the prestressing member 50.

I claim:

1. An anchor-clamp for clamping to a prestressing member in a prestressed concrete construction comprising: a pair of clamps arranged in an aligned face-to-face relationship, an opening extending through said aligned clamps for receipt of a prestressing member, each of said clamps including an activator portion, means for moving the activator portion of said clamps towards and away from each other, and gripping wedges in each of said clamps positioned to be activated by said activators to clamp a prestressing member positioned in said opening when said activator of said clamps are moved apart; each of said activator portions including a tubular member extending therefrom and toward the other of said tubular members, said means for moving the activator portions including a rotatable compression member engaged with both of said tubular members, and the engagement of said compression member with said tubular members being such that upon rotation of said compression member in one direction said activators move toward each other and upon rotation in the opposite direction said activators move away from each other to effect gripping of the prestressing member by the gripping wedges.

2. The anchor-clamp of claim 1 in which each of said clamps includes a sleeve with a hub, said hub having a frusto-conical opening therein, and said gripping wedges being positioned within said frusto-conical opening.

3. In a prestressed concrete slab construction having at least one elongated prestressing member anchored at both ends, the prestressing member being within the concrete of and extending throughout the length of the slab, said slab being supported at its ends and in at least one intermediate point between the ends, the improvement comprising an anchor-clamp clamped to the prestressing member at a point intermediate its length and over an underlying support, and said clamp being embedded in the concrete of said slab; said anchor-clamp comprising a pair of similar clamps arranged in aligned face-to-face relationship, an opening extending through said aligned clamps, said prestressing member extending through said opening, each of said clamps including a sleeve having a hub, said opening extending through said sleeve including said hubs, the portions of each said opening located within said hubs being frusto-conical, each of said hubs having a plurality of gripping wedges positioned in its frusto-conical opening, said wedges being wedged between their respective hubs and said prestressing member to securely grip said prestressing member in the area of each of said hubs, each of said clamps having an actuation member, each of said actuation clamps being engaged with the wedges of its respective clamp, a compression member engaged with both of said activator members and maintaining said activators in engagement with said wedges and thus said wedges in gripping relationship with said prestressing member.

* * * * *